US007609237B2

(12) United States Patent
Ragonesi et al.

(10) Patent No.: US 7,609,237 B2
(45) Date of Patent: Oct. 27, 2009

(54) CIRCUIT APPARATUS WITH LED DIODES

(75) Inventors: Gianluca Ragonesi, Fiumefreddo Di Sicilia (IT); Patrizia Milazzo, S. Agata Li Battiati (IT); Salvatore Musumeci, Fiumefreddo Di Sicilia (IT); Giuseppe Platania, Catania (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 653 days.

(21) Appl. No.: 11/351,335

(22) Filed: Feb. 9, 2006

(65) Prior Publication Data

US 2006/0192498 A1 Aug. 31, 2006

(30) Foreign Application Priority Data

Feb. 11, 2005 (EP) ..... 05425066

(51) Int. Cl.
*G09G 3/32* (2006.01)

(52) U.S. Cl. ..... 345/82; 315/209

(58) Field of Classification Search ..... 345/39, 345/40, 41, 82, 102; 348/69, 70
See application file for complete search history.

(56) References Cited

U.S. PATENT DOCUMENTS

| | | | | |
|---|---|---|---|---|
| 7,129,679 | B2 * | 10/2006 | Inaba et al. | 323/222 |
| 7,365,718 | B2 * | 4/2008 | Tsuchida et al. | 345/82 |
| 2002/0047642 | A1 * | 4/2002 | Miyagawa | 315/307 |
| 2002/0105373 | A1 * | 8/2002 | Sudo | 327/538 |

* cited by examiner

*Primary Examiner*—Richard Hjerpe
*Assistant Examiner*—Carolyn R Edwards
(74) *Attorney, Agent, or Firm*—Lisa K. Jorgenson; Robert Iannucci; Seed IP Law Group PLLC

(57) ABSTRACT

A circuit apparatus with LED diodes includes a plurality of circuit branches in which each circuit branch comprises at least one LED diode. The apparatus comprises a device for the supply of said plurality of circuit branches and each circuit branch is connected singularly to the supply device. The supply device comprises a controller suitable for commanding the supply of each circuit branch of the plurality of circuit branches independently from the other circuit branches of the plurality.

16 Claims, 6 Drawing Sheets

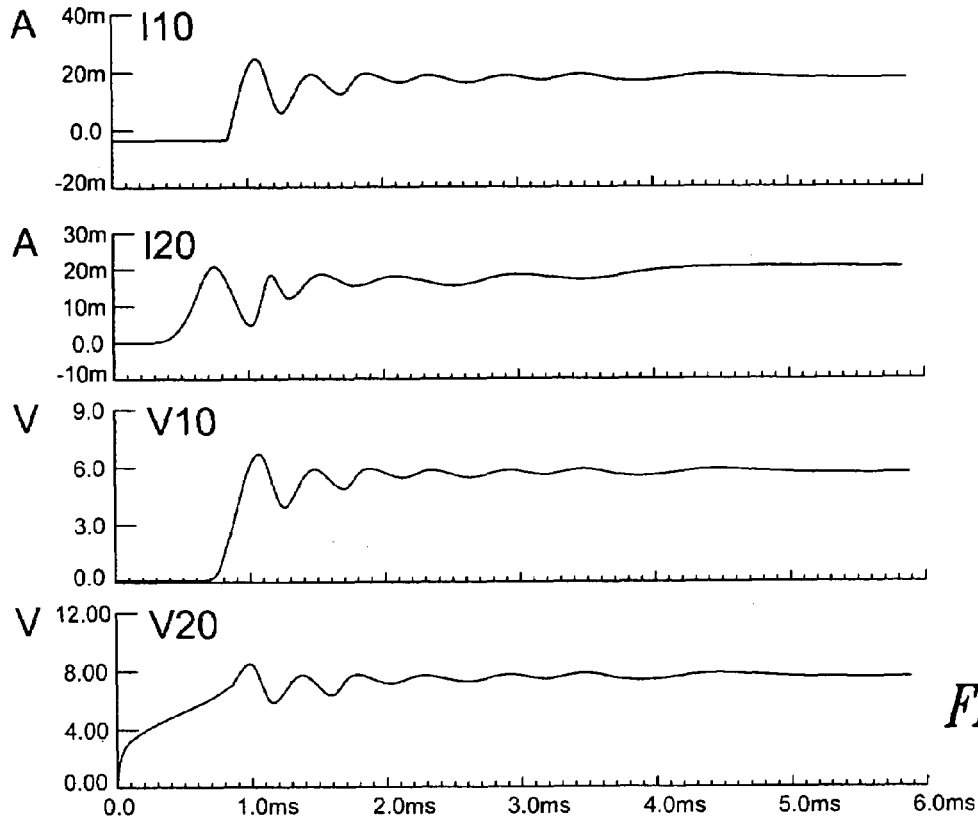
FIG. 4
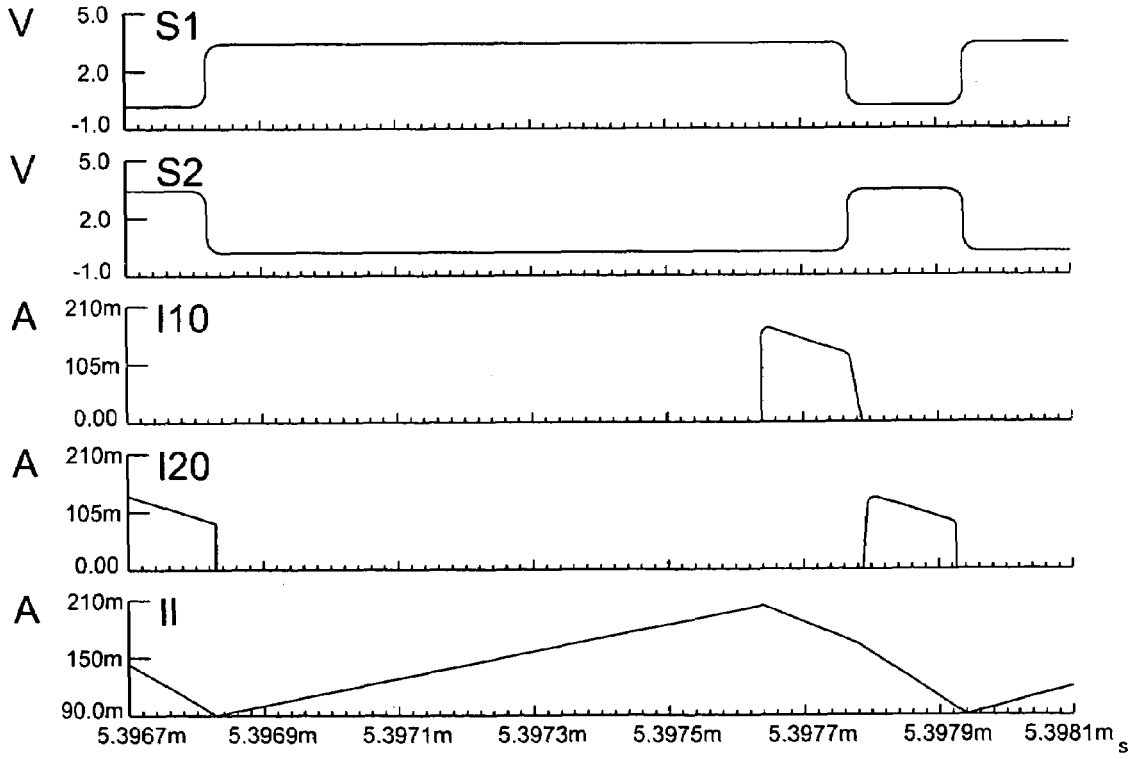

CIRCUIT APPARATUS WITH LED DIODES

BACKGROUND OF THE INVENTION

1. Field of the Invention

The present invention refers to a circuit apparatus with LED diodes.

2. Description of the Related Art

Liquid crystal displays are widely used in mobile telephones; said displays use a large number of LED diodes to permit the phenomenon of backlighting. The LED diodes are distributed in the displays uniformly and use the same bias current; to obtain this they are connected in series.

To feed chains of serially connected LED diodes for emission of white light, devices suitable for increasing the feed voltage above the value of the feed voltage at their input are employed.

The most adopted circuit solutions provide for the use of a boost converter which, supply many branches connected in parallel and each one made up of a series of LED diodes, permit the setting of the current or the voltage on each one.

To regulate the current that passes through one or more branches of LED diodes there are two different modes: a current one and a voltage one. In both methods all the branches supplied by the boost converter are connected in parallel.

In the first mode only the current of the main branch can be set. The output current is read and compared with a reference to generate a control in pulse width modulation (PWM) mode; the circuit branches that are not controlled directly can even have a current very different from that of the main branch.

The disadvantage lies in the parallel connection of the circuit branches. Even if the current that flows in the main branch with the highest number of diodes is controlled directly, the secondary circuit branches can have an additional voltage and a different current. Adding a series of resistances in the secondary branches the current set on the main branch can be reached seeing that the resistances compensate the voltage jump error between the main branch and the secondaries that is due to the connection in parallel. In any case even if the object is reached a consistent quantity of power dissipation (on the compensation resistances) causes the decrease in the efficiency of the control.

This disadvantage can be present not only when supply the circuit branches with a different number of diodes, but also if the number of LED diodes is equal in all the branches. In fact the voltage jump between the LED diodes could be different even if the same current flows. As a consequence it is necessary to impose a different voltage jump for each branch, but this is not possible by connecting all the branches in parallel. Only by regulating the current that flows through the circuit branches with a maximum value of voltage jump and inserting variable resistances in the other circuit branches the parallel connection can be maintained.

Another problem lies nevertheless in the method of identifying the circuit branch with the highest voltage jump by adjusting the other branches with resistances and then adding power consumption.

BRIEF SUMMARY OF THE INVENTION

One embodiment of the present invention provides a circuit apparatus with LED diodes without the parallel connection of the circuit branches with the LED diodes.

In one embodiment of the present invention, a circuit apparatus with LED diodes comprises a plurality of circuit branches, each circuit branch of the plurality comprising at least one LED diode. The, said apparatus includes a device for supply the plurality of circuit branches, each circuit branch of the plurality being connected singularly to the supply device. The supply device includes a controller suitable for commanding the supply of each circuit branch of the plurality of circuit branches independently from the other circuit branches of the plurality.

In accordance with the present invention it is also possible to provide a method for the supply of a plurality of circuit branches, each circuit branch of the plurality comprising at least one LED diode. The method includes a respective phase for commanding the supply of each circuit branch of the plurality of circuit branches independently from the other circuit branches of the plurality.

Thanks to the present invention it is possible to provide a circuit apparatus with a minor consumption of power in comparison to the known apparatus.

BRIEF DESCRIPTION OF THE SEVERAL VIEWS OF THE DRAWING(S)

The characteristics and advantages of the present invention will appear evident from the following detailed description of an embodiment thereof, illustrated as non-limiting example in the enclosed drawings, in which:

FIG. 4 shows time diagrams relative to signals in question in the apparatus of FIG. 2;

DETAILED DESCRIPTION OF THE INVENTION

Figure 1:
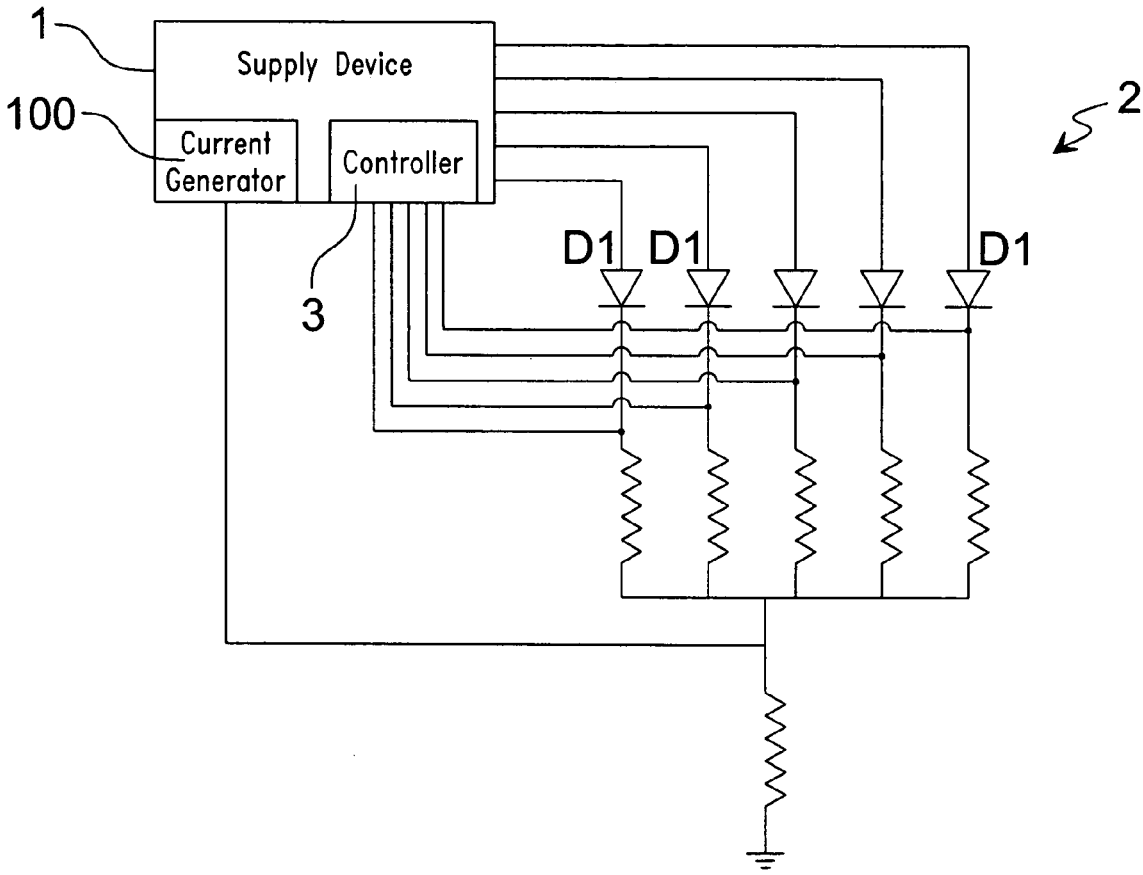
FIG. 1 shows a circuit diagram of the circuit apparatus with LED diodes in accordance with the present invention.

FIG. 1 shows a circuit apparatus with LED diodes. Said apparatus comprises a supply device 1 and a plurality 2 of N circuit branches; each circuit branch comprises at least one LED diode D1 of a liquid crystal display. Each circuit branch is connected singularly to the supply device 1 and is fed independently by the other circuit branches.

Preferably the supply device 1 comprises a controller 3 suitable for commanding the supply of said plurality of circuit branches according to a predefined time sequence. Therefore if we indicate with T the supply time period of the plurality 2 of n circuit branches, said time period T comprises n time periods T1-Tn and each circuit branch of the plurality 2 is fed at least in one of the time periods T1-Tn, in particular in only one time period, and is not fed in the remaining time periods. The behavior of the supply device 1 is based on the accumulation of energy of the coil present inside said device and in the distribution of said energy step by step.

The supply device 1 comprises in particular a current generator 100 whose value is given by the sum of the currents that must be supplied to the circuit branches of the plurality 2.

The controller 3 of the supply device 1 comprises a PWM controller that is connected to the terminals of the plurality 2 of N circuit branches.

Figure 2:
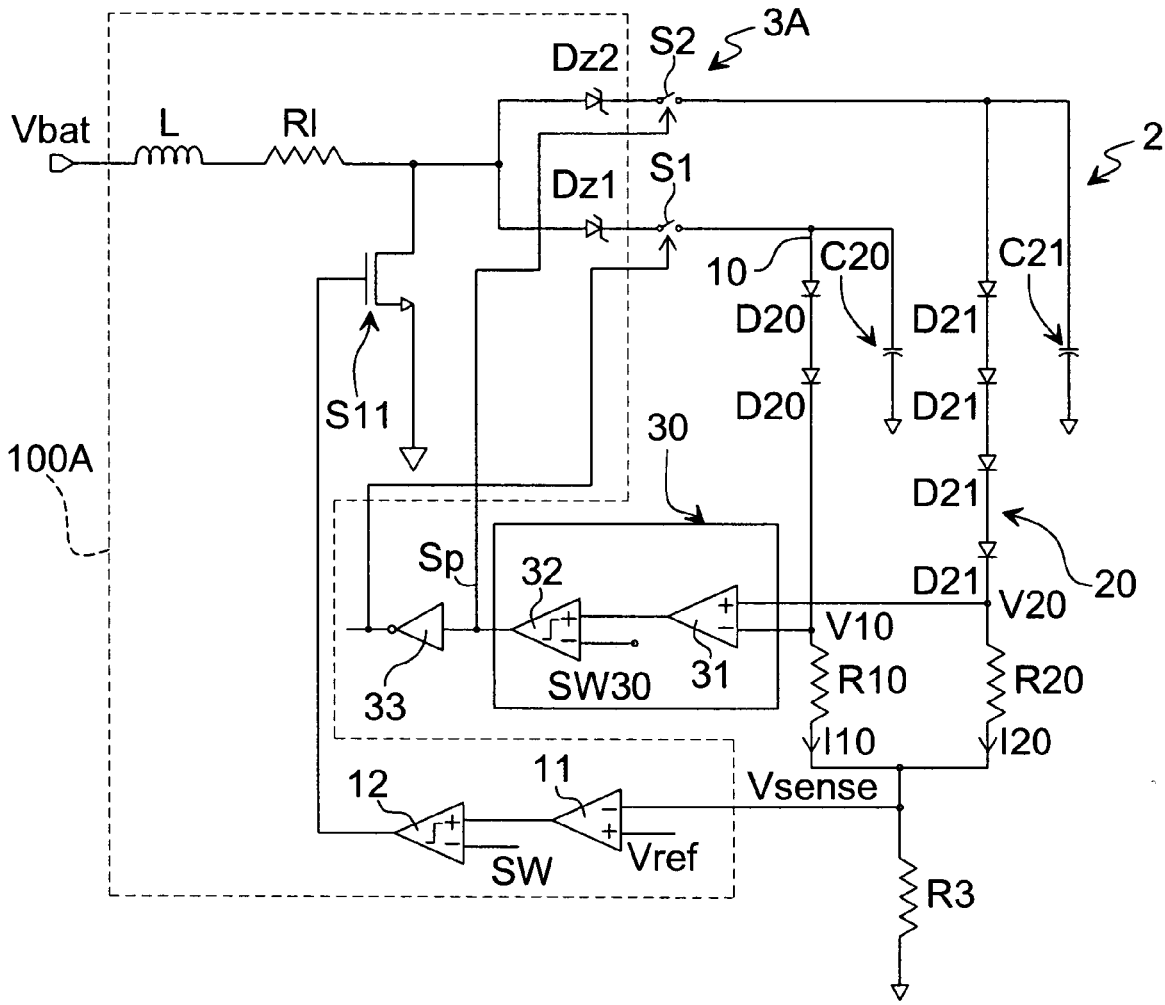
FIG. 2 shows more in detail a circuit diagram of the apparatus of FIG. 1 with only two circuit branches.

FIG. 2 shows a circuit implementation of the apparatus of FIG. 1. The apparatus of FIG. 2 comprises two circuit branches 10, 20 having two terminals connected singularly to the supply device 1 and the other two terminals connected to a resistance R3 connected to ground. The current generator 100A of the supply device 1 is connected to the terminal in common of the resistance R3 and of the two circuit branches 10, 20 while the controller 3A is connected to the final part of the circuit branches 10 and 20. The current generator is made up of a boost converter of the traditional type; it comprises the series of an inductor L and a resistance RL (which is the parasitic resistance of the inductor L) connected between a voltage Vbat and a terminal of a switch S11, preferably made up of a MOS transistor. Said terminal of the switch S11 is connected to the anodes of two Schottky diodes Dz1 and Dz2 each one connected to terminals of two switches S1 and S2 whose other terminals are connected to the circuit branches 10 and 20; the switches S1 and S2 make up part of the controller 3A. The boost converter comprises an operational error amplifier 11 having in input on the inverting terminal the voltage V_sense at the terminals of the resistance R3 and at the non-inverting terminal the reference voltage Vref and a comparator 12 suitable for comparing the voltage in output from the error amplifier 11 with a sawtooth voltage SW; the output of the comparator 12 drives the switch S11.

The circuit branch 10 comprises two LED diodes D20 and a resistance R10 connected to the resistance R3; a capacitor C20 is connected between a terminal of the branch 10 in common with the switch S1 and ground. The circuit branch 20 comprises four LED diodes D21 connected in series and a resistance R20 connected to the resistance R3; the capacitor C21 is connected between a terminal of the branch 20 in common with the switch S2 and ground.

The controller 3A comprises a PWM controller 30 which in turn comprises an operational error amplifier 31 having in input on the inverting and non-inverting terminals the signals taken on the terminals of the resistances R10 and R20 and a comparator 32 suitable for comparing the signal in output from the error amplifier 31 with a sawtooth signal SW30 having frequency equal to that of the signal SW. The signal Sp in output from the comparator 32 drives directly the switch S2 while its negated, obtained by means of an inverter 33 belonging to the controller 3A, drives the switch S1. In this manner the supply of the circuit branches 10 and 20 does not come about simultaneously but alternately, first at a circuit branch and then at the other.

The PWM controller 30 has in input the voltages V10 and V20 given by V10=R3*I+R10*I10 and V20=R3*1+R20*120. In stationary conditions, because of the feedback, the voltages V10 and V20 have the same value and therefore we have $$\frac{I20}{I10} = \frac{R10}{R20} = K.$$

Given that the current I30 is equal to the sum of the currents I10 and I20, we have that the current $$I10 = \frac{I30}{K+1} = \frac{Vref}{R3(K+1)}$$

and $$I20 = \frac{K*I30}{K+1} = \frac{K*Vref}{R3(K+1)}.$$

In this manner setting the values of the resistances R10, R20, R3 and the reference voltage Vref it is possible to set the currents that flow through the circuit branches 10 and 20.

Figure 3:
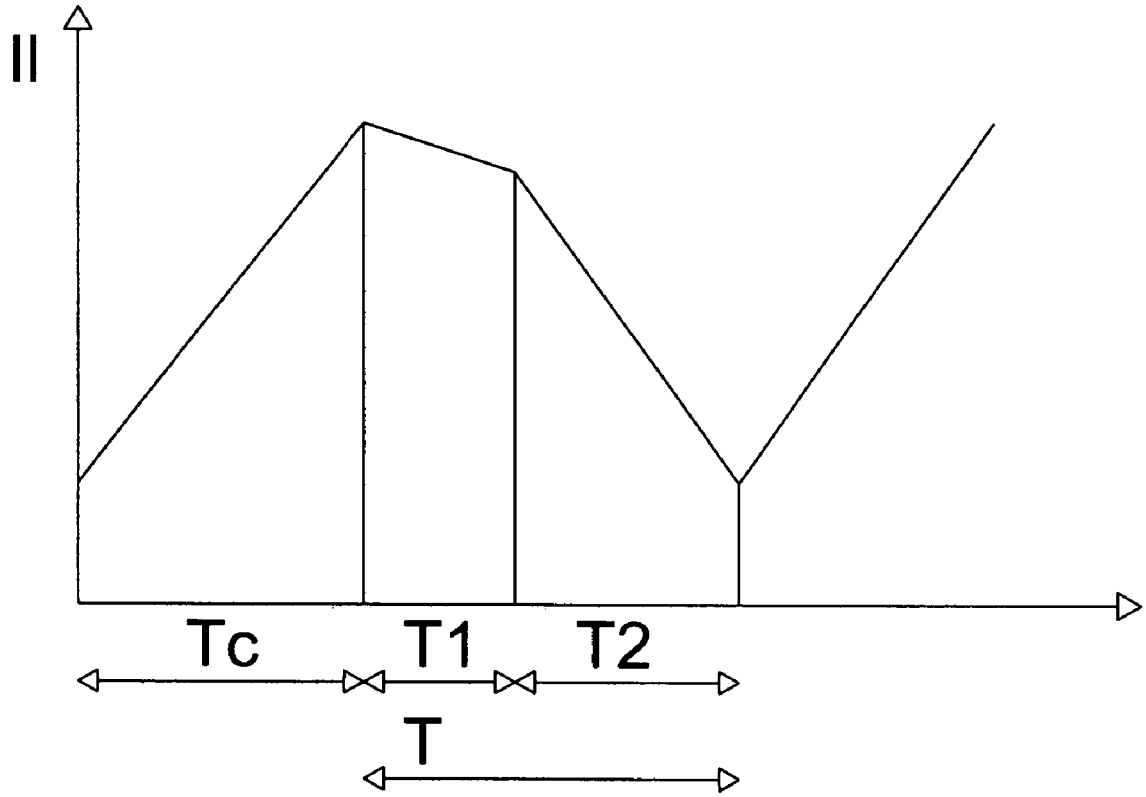
FIG. 3 shows the time path of the current in the inductance.

As can be seen in FIG. 3, in the case in which the apparatus comprises only two circuit branches 10, 20, the PWM controller 30 sets the different time windows T1 and T2 suitable for the phase of loading the circuit branches 10 and 20 once the time period Tc for loading the inductor L has passed; therefore the supply of the two circuit branches 10 and 20 does not come about simultaneously but in different time periods. More precisely the PWM controller sends two pulses of length T1 and T2 and regulates the currents in the two circuit branches 10 and 20 by means of two different feedbacks.

FIG. 4 shows the time diagrams of the currents I10 and I20 and of the voltages V10 and V20 choosing K=1. The currents I10 and I20 are equal while the voltages V10 and V20 are different because of the presence of a different number of LED diodes in the two circuit branches. The Figure also shows the time diagram of the current 11 that flows through the inductor L, the currents I10 and I20 that cross the switches S1 and S2 and the drive signals of the switches S1 and S2 in a brief interval of time.

If the circuit branches 10 and 20 of the apparatus of FIG. 2 were connected in parallel as in the known case, we would have a consumption of power Pc1=Vout10*I10+Vout20*I20=Vout20(I10+I20) where with Vout10 and Vout20 the voltages at the terminals of the circuit branches 10 and 20 are indicated and the branch 20 can be considered as the main branch because it contains the greatest number of LED diodes. Indicating with Vd21 the voltage at the terminals of the diode D21 we have:

$$Pc1=4*Vd21*I10+R20*I20^2+4*Vd21*I20+R20*I10*I20.$$

In the case of the apparatus of FIG. 2, indicating with Vd20 the voltage at the terminals of the diode D20 we have a power consumption given by:

$$Pc2=out10*I10+Vout20*I20 =2*Vd20*I10+R10*I10^2+4*Vd21*I20+R20*I20^2.$$

The difference DP between the power consumptions Pc1 and Pc2 is DP=(4*Vd21−2*Vd20)*I10+R20*I10*I20-R10*I102. With R10*I10=R20*I20 and considering Vd20=Vd2 we have DP=2*I10*Vd20. In the case in which the number of the LED diodes in the circuit branches 10 and 20 is equal, being R10*I10=R20*I20 and considering the voltage Vd20 different from the voltage Vd21, we would have the difference DP depending on the difference of the voltage at the terminals of the two diodes, that is from Vd21-Vd20 and we would also have a positive value of the difference of power consumptions DP.

Figure 5:
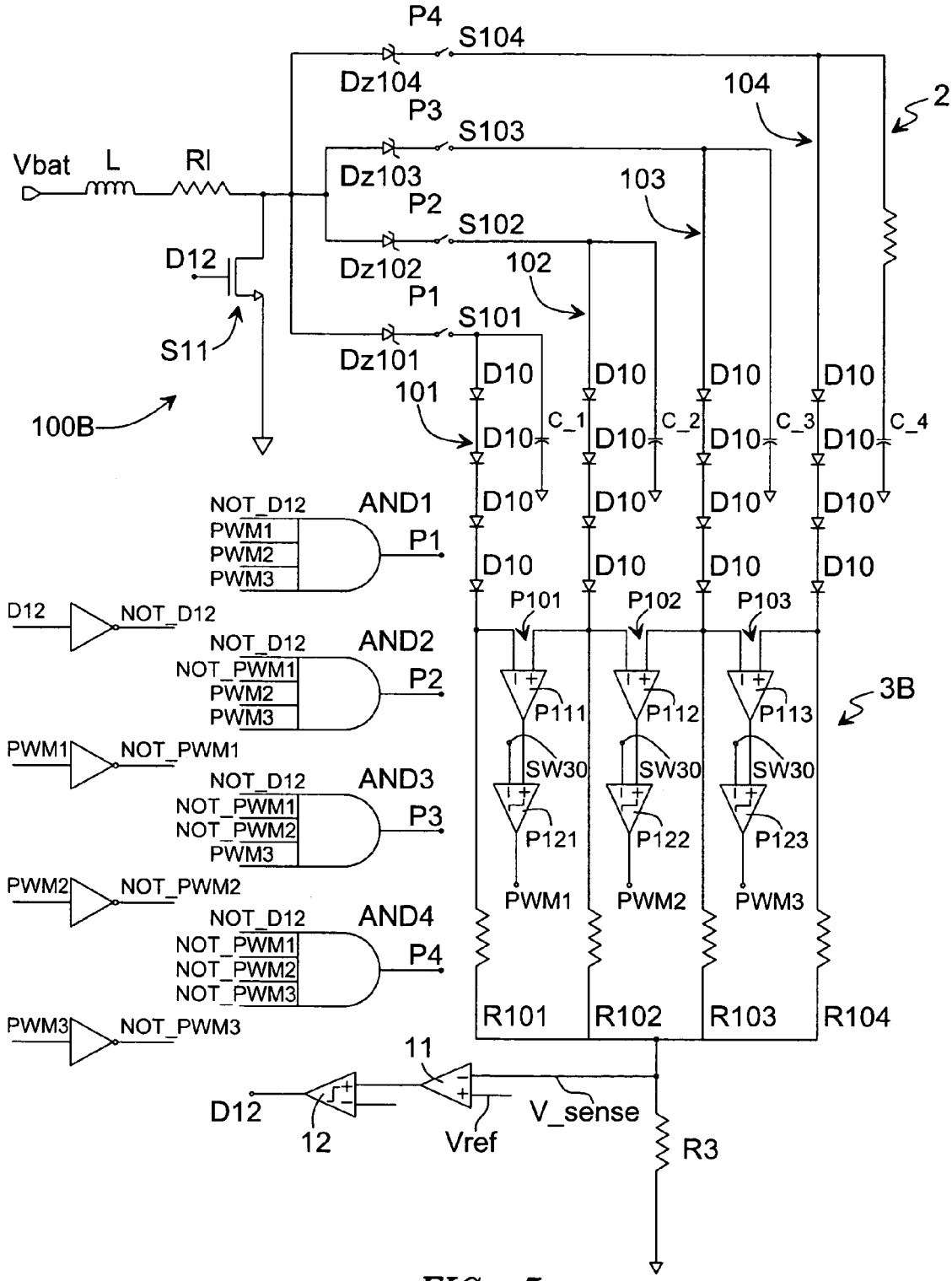
FIG. 5 shows more in detail a circuit diagram of the apparatus of FIG. 1 with four circuit branches.

FIG. 5 shows another circuit implementation of the apparatus shown in FIG. 1. The apparatus of FIG. 5 comprises four circuit branches 101, 102, 103, 104 having four terminals connected singularly to the supply device 1 and the other four terminals connected to the resistance R3 connected to ground. The current generator 100B of the supply device 1 is connected to the terminal in common of the resistance R3 and of the four circuit branches 101-104 while the controller 3B is connected to the final part of the circuit branches 101-104. The current generator 100 B is made up of a boost converter of the traditional type; it comprises the series of the inductor L and the resistance RL connected between the voltage Vbat and a terminal of the switch S11, preferably made up by a MOS transistor. Said terminal of the switch S11 is connected to the anodes of four Schottky diodes Dz101-Dz04 connected each one to terminals of four switches S101-S104 whose other terminals are connected to the circuit branches 101-104; the switches S101-S104 make up part of the controller 3B.

The boost converter comprises an operational error amplifier 11 having in input on the inverting terminal the voltage V_sense at the terminals of the resistance R3 and at the non-inverting terminal the reference voltage Vref and a comparator 12 suitable for comparing the voltage in output from the error amplifier 11 with a sawtooth voltage SW; the output D12 of the comparator 12 drives the switch S11.

The circuit branches 101-104 each comprise four LED diodes D10 connected in series and resistances R101-R104 connected to the resistance R3; respective capacitors C_1-C_4 are connected between the terminals of the branches 101-104 that are in common with the switches S101-S104 and ground.

The controller 3B comprises three PWM controllers P101-P103 which in turn comprise operational error amplifiers P111 -P113 having respectively in input on the inverting and non-inverting terminals the signals taken at the terminals of the resistances R101 and R102, R102 and R103, R103 and R104. The controller 3B comprises comparators P121-P123 suitable for comparing the signal in output from the respective error amplifiers P111-P113 with a sawtooth signal SW30 having frequency equal to that of the signal SW. The signals PWM1-PWM3 in output from the comparators P121-P123 are sent to ports NOT to obtain the negated signals NOT_PWM1-NOT_PWM3 and also the signal D12 is sent to a port NOT to obtain the negated signal NOT-D12. The signals PWM1-PWM3, D12, NOT—PWM1-NOT—PWM3 and NOT—D12 are sent to four ports AND AND1-AND4 whose signals in output P1-P4 drive the switches S101-S104. More precisely the signals PWM1-PWM3, NOT—D12 are sent in input to the port AND1, the signals NOT—PWM1, PWM2, PWM3, NOT—D12 are sent in input to the port AND2, the signals NOT—PWM1, NOT—PWM2, PWM3, NOT—D12 are sent in input to the port AND3 and the signals NOT—PWM1—NOT—PWM3, NOT—D12 are sent in input to the port AND4. In this manner the supply of the circuit branches 101-104 does not come about simultaneously but according to a time sequence; each one of the switches S101-S104 is turned on only for a respective time period T1-T4 where the sum of the periods T1-T4 is equal to the supply time T. In particular the turning-on of the switches S101-S104 comes about in succession to have a differentiated supply in time and not simultaneous with the circuit branches 101-104.

Figure 6:
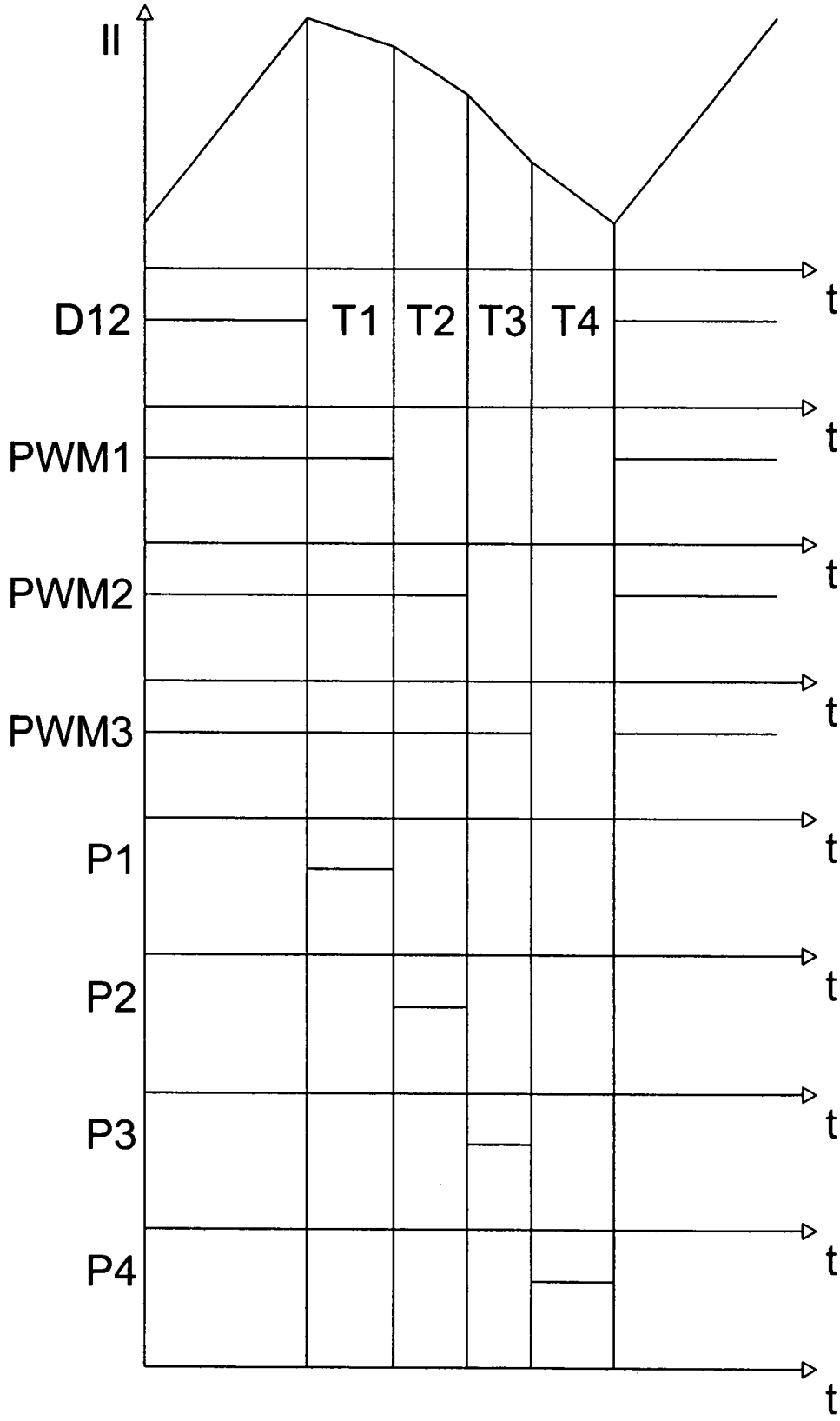
FIG. 6 shows time diagrams of the signals in question for the apparatus of FIG. 5.

FIG. 6 shows time diagrams of the current II of the inductor L, of the signal D12, of the signals PWM1-PWM3 and of the signals S101-S104.

The supply device 1 can work continuously (that is when the energy stored in the inductor L does not become nil when the supply period finishes) or discontinuously (that is when the energy stored in the inductor L becomes nil when the supply time finishes). The way of continuous or discontinuous operating depends mainly on the frequency of work used.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A circuit apparatus, comprising:

a plurality of circuit branches, each circuit branch of said plurality comprising at least one LED diode; and a supply device that supplies said plurality of circuit branches, the supply device being connected singularly to each circuit branch of said plurality, said supply device comprising control means suitable for commanding the supply of each circuit branch of the plurality of circuit branches independently from the other circuit branches of the plurality, wherein said control means comprise pulse width modulation means connected to said plurality of circuit branches and suitable for driving said plurality of switches so as to determine the turning-on of each switch of said plurality of switches in succession and for a respective one of the time periods of the time sequence of time periods, and wherein said pulse width modulation means include a plurality of operational error amplifiers each one of which having input terminals connected respectively to a circuit branch of said plurality of circuit branches and to an adjacent circuit branch.

2. The apparatus according to claim 1, wherein said control means are suitable for commanding the supply of said plurality of circuit branches in succession and for at least one time period of a time sequence of time periods.

3. The apparatus according to claim 2, wherein said supply device comprises supply means suitable for supplying a supply current to each single circuit branch of said plurality, and said control means comprise a plurality of switches positioned between said circuit branches and said supply means.

4. The apparatus according to claim 1, wherein said pulse width modulation means comprise:

a plurality of comparators each suitable for comparing an output signal of a respective one of the error amplifiers with a sawtooth signal, the plurality of comparators providing respective output signals suitable for determining respective drive signals of said plurality of switches.

5. The apparatus according to claim 1, wherein the plurality of circuit branches comprises N circuit branches, with N being a whole number greater than or equal to two, the plurality of switches comprises N switches, the plurality of operational error amplifiers comprises N−1 error amplifiers, and the plurality of comparators comprises N−1 comparators associated with said error amplifiers.

6. The apparatus according to claim 5, wherein the circuit branches of said plurality of circuit branches have a terminal in common connected to a resistance coupled with a ground, said supply means comprise:

an operational error amplifier connected to said terminal in common and suitable for comparing a voltage signal detected on said terminal in common With a reference signal;

a comparator suitable for comparing an output signal from said operational error amplifier with a sawtooth signal, the comparator of the supply means providing an output signal that is sent, together with the output signals of said comparators of said control means, to a logic block that determines the drive signals of said plurality of switches.

7. The apparatus according to claim 6, wherein said logic block comprises AND gates and inverters.

8. A circuit apparatus, comprising:

a plurality of circuit branches, each circuit branch of said plurality comprising at least one LED diode; and a supply device that supplies said plurality of circuit branches, the supply device being connected singularly to each circuit branch of said plurality, said supply device comprising control means suitable for commanding the supply of each circuit branch of the plurality of circuit branches independently from the other circuit branches of the plurality, wherein the plurality of circuit branches comprises two circuit branches, said control means comprising two switches, an operational error amplifier having input terminals connected to said two circuit branches, a comparator suitable for comparing an output signal from the operational error amplifier with a sawtooth signal, and an inverter that receives a comparator signal output by the comparator and outputs an inverter signal, the comparator and inverter signals being respective drive signals of the two switches.

9. The apparatus according to claim 8, wherein said control means are suitable for commanding the supply of said plurality of circuit branches in succession and for at least one time period of a time sequence of time periods.

10. The apparatus according to claim 9, wherein said supply device comprises supply means suitable for supplying a supply current to each single circuit branch of said plurality, and said control means comprise a plurality of switches positioned between said circuit branches and said supply means.

11. A circuit apparatus, comprising:

a first circuit branch that includes a first LED diode;

a second circuit branch that includes a second LED diode;

a power supply; and switching circuitry that alternately provides power from the power supply to the first and second circuit branches, the switching circuitry including a first switch connected between the power supply and the first circuit branch, a second switch connected between the power supply and the second circuit branch, and a controller, wherein the controller includes a first error amplifier having a first input coupled to the first branch, a second input coupled to the second branch, and an output that provides a first error signal based on a difference between a voltage of the first branch and a voltage of the second branch, the controller being structured to alternately turn-on the first and second switches based on the first error signal.

12. The apparatus of claim 11 wherein the controller includes a first comparator having a first input coupled to the output of the first error amplifier, a second input coupled to a sawtooth signal, and an output that supplies a first comparator signal based on a comparison of the first error and sawtooth signals, the controller being structured to alternately turn-on the first and second switches based on the first comparator signal.

13. The apparatus of claim 12, wherein the controller includes an inverter having an input coupled to the output of the first comparator and an output that supplies an inverted comparator signal, the first and second switches having respective control terminals coupled respectively to the input and output of the inverter such that the first and second switches are respectively controlled by the first comparator and inverted comparator signals.

14. The apparatus of claim 12, further comprising:

a resistance coupled between a ground reference and a terminal in common of the first and second circuit branches;

a second error amplifier having a first input connected to the terminal in common, a second input connected to a reference signal, and an output that supplies a second error signal based on a difference between a voltage of the terminal in common and the reference signal;

a second comparator having a first input coupled to the output of the second error amplifier, a second input coupled to the sawtooth signal, and an output that supplies a second comparator signal based on a comparison of the second error and sawtooth signals; and a logic block having a first input coupled to the output of the first comparator, a second input coupled to the output of the second comparator, and an output that provides a control signal that controls the first switch.

15. The apparatus of claim 11, wherein the first and second circuit branches are two of a plurality of circuit branches and the switching circuitry is structured to alternately provide power from the power supply to all of the circuit branches of the plurality.

16. The apparatus of claim 15, wherein the switching circuitry includes:

a plurality of switches connected respectively between the power supply and the plurality of circuit branches; and a pulse width modulation controller connected to the plurality of switches and structured to drive the plurality of switches in succession.

* * * * *

UNITED STATES PATENT AND TRADEMARK OFFICE

CERTIFICATE OF CORRECTION

PATENT NO. : 7,609,237 B2
APPLICATION NO. : 11/351335
DATED : October 27, 2009
INVENTOR(S) : Ragonesi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 913 days.

Signed and Sealed this

Twelfth Day of October, 2010

David J. Kappos

David J. Kappos
*Director of the United States Patent and Trademark Office*